US011618643B2

(12) United States Patent
Kamichi

(10) Patent No.: US 11,618,643 B2
(45) Date of Patent: Apr. 4, 2023

(54) SHEET STORAGE APPARATUS AND IMAGE FORMING APPARATUS

(71) Applicant: Junpei Kamichi, Tokyo (JP)

(72) Inventor: Junpei Kamichi, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 119 days.

(21) Appl. No.: 17/088,688

(22) Filed: Nov. 4, 2020

(65) Prior Publication Data

US 2021/0155426 A1 May 27, 2021

(30) Foreign Application Priority Data

Nov. 22, 2019 (JP) ..... JP2019-211343

(51) Int. Cl.
*B65H 1/26* (2006.01)
*G03G 15/00* (2006.01)

(52) U.S. Cl.
CPC ..... *B65H 1/266* (2013.01); *G03G 15/6502* (2013.01); *B65H 2402/412* (2013.01); *B65H 2405/115* (2013.01); *B65H 2405/12* (2013.01); *B65H 2405/141* (2013.01)

(58) Field of Classification Search
CPC .... B65H 1/04; B65H 1/266; B65H 2402/412; B65H 2405/11; B65H 2405/115; B65H 2405/12; B65H 2405/141; B65H 2405/32
See application file for complete search history.

(56) References Cited

U.S. PATENT DOCUMENTS

| | | | | |
|---|---|---|---|---|
| 7,817,953 | B2 | 10/2010 | Ishibashi et al. | |
| 2005/0254873 | A1 | 11/2005 | Murakami et al. | |
| 2007/0164505 | A1 | 7/2007 | Ishibashi et al. | |
| 2007/0172277 | A1* | 7/2007 | Hasegawa ..... | G03G 15/6502 399/393 |
| 2007/0217844 | A1 | 9/2007 | Yasuhara et al. | |
| 2008/0128947 | A1 | 6/2008 | Sakamoto | |

(Continued)

FOREIGN PATENT DOCUMENTS

| | | | |
|---|---|---|---|
| CN | 101004570 | A | 7/2007 |
| EP | 1595708 | A | 11/2005 |

(Continued)

OTHER PUBLICATIONS

CA Extended European Search Report dated Apr. 23, 2021.
Chinese Office Action dated Apr. 28, 2022 for Chinese Patent Application No. 202011304406.0.

*Primary Examiner* — Prasad V Gokhale
(74) *Attorney, Agent, or Firm* — Harness, Dickey & Pierce P.L.C.

(57) ABSTRACT

A sheet storage apparatus includes a sheet housing portion, a handle for drawing the sheet housing portion, and a cover member. The sheet housing portion is drawably disposed in the apparatus main body and configured to house a sheet. The cover member is mounted to an end portion of the sheet housing portion in a drawing direction and having, in a portion facing the handle, a recess toward a sheet housing portion. A contact portion configured to come into contact with the sheet housing portion is disposed at a position corresponding to a portion in which the recess is formed, on a facing surface of the cover member, the facing surface facing the sheet housing portion.

8 Claims, 7 Drawing Sheets

(56) References Cited

U.S. PATENT DOCUMENTS

| | | | | |
|---|---|---|---|---|
| 2012/0063829 | A1* | 3/2012 | Matsuyama | B65H 1/266 271/145 |
| 2014/0145393 | A1* | 5/2014 | Naoi | B65H 1/04 271/145 |
| 2014/0319759 | A1* | 10/2014 | Fujii | B65H 7/04 271/162 |
| 2015/0102552 | A1* | 4/2015 | Doshida | G03G 15/6502 271/171 |
| 2015/0132039 | A1 | 5/2015 | Tobinaga et al. | |
| 2015/0239265 | A1* | 8/2015 | Lo | B65H 1/266 347/104 |
| 2015/0251864 | A1 | 9/2015 | Aoyama et al. | |
| 2017/0036873 | A1 | 2/2017 | Sekigawa | |
| 2019/0039842 | A1 | 2/2019 | Aoyama et al. | |
| 2019/0225438 | A1 | 7/2019 | Aoyama et al. | |

FOREIGN PATENT DOCUMENTS

| | | | |
|---|---|---|---|
| EP | 1804132 | A1 | 7/2007 |
| JP | 2007-277003 | | 10/2007 |
| JP | 2017-132630 | A | 8/2017 |

* cited by examiner

SHEET STORAGE APPARATUS AND IMAGE FORMING APPARATUS

CROSS-REFERENCE TO RELATED APPLICATIONS

The present application claims priority under 35 U.S.C. § 119 to Japanese Patent Application No. 2019-211343, filed on Nov. 22, 2019. The contents of which are incorporated herein by reference in their entirety.

BACKGROUND OF THE INVENTION

1. Field of the Invention

The present invention relates to a sheet storage apparatus and an image forming apparatus.

2. Description of the Related Art

Conventionally, a sheet storage apparatus including a sheet housing portion that is drawably disposed in an apparatus main body and houses sheets, a handle for drawing the sheet housing portion, and a cover member that is mounted to an end portion of the sheet housing portion in a drawing direction and has, in a portion facing the handle, a recess toward the sheet housing portion has been known.

As the above-described sheet storage apparatus, an apparatus in which a handle is arranged on a cover member and both ends of the cover member in a sheet width direction are mounted to an end portion of a sheet housing portion in a drawing direction is described in Japanese Patent No. 4733606.

However, in some cases, appearance quality of the apparatus may be degraded due to a cover member in which variability with respect to a predetermined shape has occurred during manufacturing.

SUMMARY OF THE INVENTION

According to an aspect of the present invention, a sheet storage apparatus includes a sheet housing portion, a handle for drawing the sheet housing portion, and a cover member. The sheet housing portion is drawably disposed in the apparatus main body and configured to house a sheet. The cover member is mounted to an end portion of the sheet housing portion in a drawing direction and having, in a portion facing the handle, a recess toward a sheet housing portion. A contact portion configured to come into contact with the sheet housing portion is disposed at a position corresponding to a portion in which the recess is formed, on a facing surface of the cover member, the facing surface facing the sheet housing portion.

BRIEF DESCRIPTION OF THE DRAWINGS

The accompanying drawings are intended to depict exemplary embodiments of the present invention and should not be interpreted to limit the scope thereof. Identical or similar reference numerals designate identical or similar components throughout the various drawings.

DESCRIPTION OF THE EMBODIMENTS

Figure 1:
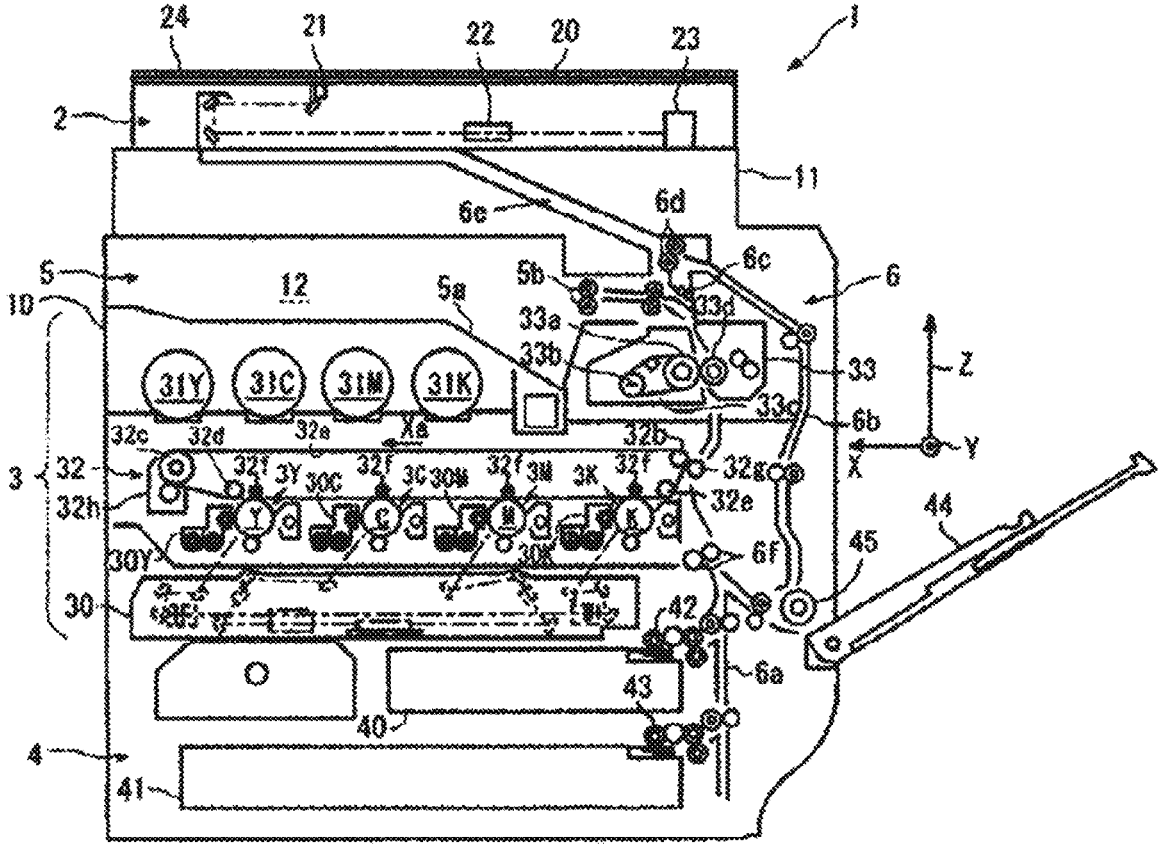
FIG. 1 is a schematic transparent front view illustrating an entire configuration of a color copier.

The terminology used herein is for the purpose of describing particular embodiments only and is not intended to be limiting of the present invention.

As used herein, the singular forms "a", "an" and "the" are intended to include the plural forms as well, unless the context clearly indicates otherwise.

In describing preferred embodiments illustrated in the drawings, specific terminology may be employed for the sake of clarity. However, the disclosure of this patent specification is not intended to be limited to the specific terminology so selected, and it is to be understood that each specific element includes all technical equivalents that have the same function, operate in a similar manner, and achieve a similar result.

An embodiment of the present invention will be described in detail below with reference to the drawings.

FIG. 1 is a schematic transparent front view illustrating an entire configuration of a color copier, as one example of an image forming apparatus according to an embodiment of the present invention.

In FIG. 1, a reference numeral 1 denotes a color copier of an intra-body paper ejection type using an electrophotographic system, which is illustrated as an example of an image forming apparatus according to the embodiment of the present invention.

In FIG. 1, a Z direction indicates a vertical direction, a Y direction indicates a front-back direction (corresponding to an axial direction) of the apparatus, and an X direction indicates a left-right direction of the apparatus.

The color copier 1 includes an apparatus main body 10 that serves as a housing of the entire image forming apparatus and has an approximately box shape with an open top surface (uppermost surface), and an image reading unit 2 that is arranged above the apparatus main body 10 and reads an image of a document. The color copier 1 further includes an image forming unit 3 that is arranged inside the apparatus main body and records or forms an image on paper, which is one example of a sheet, on the basis of image information that is read by the image reading unit 2 or that is transmitted from an external apparatus, such as a personal computer.

Furthermore, includes a support 11 by which a paper ejection space 12 for ejecting paper with a recorded image is formed between the image reading unit 2 and the image forming unit 3 and which supports and fixes the image reading unit 2 above the image forming unit 3 so as to surround side surfaces of the paper ejection space 12 in at least two directions is included. Moreover, a paper feed unit 4 that is arranged in a lowermost part of the apparatus main body 10 and feeds a sheet (indicating a sheet recording medium including copy paper, an overhead projector (OHP) resin sheet, thick paper, a postcard, and the like; hereinafter, representatively referred to as "paper") to a paper conveying path as a sheet conveying path, a paper ejection unit 5 that is arranged above the image forming unit 3 and ejects paper with a recorded image to the paper ejection space 12, and a paper conveying path 6 that is arranged between the paper feed unit 4 and the paper ejection unit 5 are included.

The image reading unit 2 includes a contact glass 20 that is mounted to a top surface portion of the support 11 and serves as a document table on which a document is placed, a light source 21 that is arranged just below the contact glass 20 and applies light to a document while moving, an imaging forming lens 22 that forms an image by reflected light from the document, an image sensor 23, such as a charge coupled device (CCD), that is arranged at an imaging forming position of the imaging forming lens 22 and serves as a reading unit for reading a document image, a plurality of mirrors that reflect and guide reflected light from the document to the imaging forming lens 22, and the like.

Further, a pressure plate 24 for pressing a document placed on the contact glass 20 is arranged in an upper part of the image reading unit 2. It may be possible to install an automatic document feeder (ADF) that automatically feeds a document to the contact glass 20, instead of the pressure plate 24.

The image forming unit 3 includes four process cartridges 3Y, 3C, 3M, and 3K corresponding to toner of four colors of yellow, cyan, and magenta, which are three primary colors of color materials, and black, which is a achromatic color, a writing unit 30 that is arranged below the four process cartridges 3Y, 3C, 3M, and 3K and writes a latent image on each of photoconductor drums (to be described later), four toner bottles 31Y, 31C, 31M, and 31K for storing new toner of colors corresponding to the process cartridges 3Y, 3C, 3M, and 3K, a transfer unit 32 on which a toner image formed by each of the process cartridges 3Y, 3C, 3M, and 3K is temporarily transferred and which subsequently transfers the toner image to paper, and a fixing unit 33 that fixes the toner image to the paper.

The process cartridges 3Y, 3C, 3M, and 3K are arranged in order of yellow, cyan, magenta, and black from upstream along a moving direction (an arrow Xa in the figure) of an outer peripheral surface of an intermediate transfer belt 32*a* (to be described later). The process cartridges 3Y, 3C, 3M, and 3K respectively include, around photoconductor drums Y, C, M, and K that are latent image bearers configured to rotate in clockwise directions when viewed from front, charging units that perform a charging process on outer peripheries of the photoconductor drums Y, C, M, and K, developing units 30Y, 30C, 30M, and 30K that visualize electrostatic latent images formed on the photoconductor drums Y, C, M, and K by the writing unit 30 (to be described later) into single-color toner images using toner of the corresponding colors, cleaning units that performs cleaning by collecting non-transferred toner remaining on the outer peripheries of the photoconductor drums Y, C, M, and K after transfer, and the like, and are configured to be attachable to and detachable from the apparatus main body 10.

The writing unit 30 includes a polygon mirror, an fθ lens, and the like, performs scanning while emitting laser beams from a laser emitting apparatus on the basis of image information that is input from the image reading unit 2, a personal computer, an external scanner, or the like, selectively exposes the uniformly-charged outer peripheries of the photoconductor drums Y, C, M, and K to reduce surface potential of the irradiated portions, and forms electrostatic latent images on the photoconductor drums.

The toner bottles 31Y, 31C, 31M, and 31K are individually filled with new toner of the corresponding four colors, and configured to supply toner of the corresponding colors to the developing units 30Y, 30C, 30M, and 30K of the process cartridges 3Y, 3C, 3M, and 3K through conveying paths.

The transfer unit 32 includes the intermediate transfer belt 32*a* as an intermediate transfer member that is an endless belt having a multi-layer structure and made with elastic resin, four supporting rollers 32*b*, 32*c*, 32*d*, and 32*e* by and around which the intermediate transfer belt 32*a* is supported and tensely extended (extended with a tensile force, the same applies to the following), four primary transfer rollers 32*f* that respectively face the photoconductor drums Y, C, M, and K across the intermediate transfer belt 32*a*, a secondary transfer roller 32*g* that is arranged at a position facing the supporting roller 32*b*, and the like.

The supporting roller 32*b* is a driving roller that is connected to a driving unit, and has a function to cause the intermediate transfer belt 32*a* to rotate in the direction of the arrow Xa in the figure. The secondary transfer roller 32*g* is arranged and installed (installed with certain arrangement or arranged at a determined position, the same applies to the following) at a position facing the supporting roller 32*b* (hereinafter, referred to as the "driving roller 32*b*") across the intermediate transfer belt 32*a*. A cleaning device 32*h* that performs cleaning by scraping off residual toner attached to an outer periphery of the intermediate transfer belt 32*a* is arranged in the vicinity of the supporting roller 32*c*.

Each of the primary transfer rollers 32*f* functions as a transfer bias (transfer voltage) applying unit of a contact-application system, which is arranged and installed, in consideration of image degradation due to void discharge, at a certain position that is slightly deviated downstream in the conveying direction of the intermediate transfer belt 32*a* from a correct position at which the primary transfer roller 32*f* comes into contact with each of the photoconductor drums Y, C, M, and K with a shortest center-to-center distance across the intermediate transfer belt 32*a*. Each of the primary transfer rollers 32*f* is connected to a bias power source, and configured to be able to apply primary transfer bias (apply voltage, the same applies to the following) from a back surface (inner periphery) of the intermediate transfer belt 32*a*.

The secondary transfer roller 32*g* is biased by a biasing unit so as to come into pressure contact with the intermediate transfer belt 32*a* along an outer periphery of the driving roller 32*b*, so that a secondary transfer nip is formed in a space formed with the driving roller 32*b*. Further, the driving roller 32*b* serves as a contact-type transfer bias application unit that is connected to the bias power source. Furthermore, the secondary transfer roller 32*g* may serve as the transfer bias application unit, and in this case, transfer bias with polarity opposite to that of a toner image to be transferred.

The fixing unit 33 is configured such that a fixing nip is formed between a fixing belt 33*c*, which is an endless belt that is tensely extended between a fixing roller 33*a* and a heating roller 33*b*, and a pressurizing roller 33*d* as a pressurizing member that comes into pressure contact with the fixing belt 33*c* (contacted by pressure, the same applies to the following), heat and pressure are applied, in the fixing nip, to paper that has been conveyed through the paper conveying path 6 (to be described later), and the toner image that has been transferred at the secondary transfer nip of the transfer unit 32 as described above is melted to adhere to and be fixed to the paper.

The paper feed unit 4 includes paper feed cassettes 40 and 41 serving as sheet storage apparatuses that can be drawn from the apparatus main body 10 and store or stock, as sheets, predetermined paper with different largeness or size, paper feed rollers 42 and 43 that come into pressure contact with the stocked sheets from above at predetermined pressure, and the like. The paper feed unit 4 causes the paper feed rollers 42 and 43 to feed the sheets stored in the paper feed cassettes 40 and 41 to the paper conveying path 6 (to be described later) on the basis of a control signal of a control unit.

The paper feed unit 4 further includes a manual feed tray 44 on which arbitrary paper with certain largeness or size within a range of predetermined conveyable largeness or size is placed, and a paper feed roller 45 that feeds the paper. The paper feed unit 4 is able to feed the paper placed on the manual feed tray 44 to the paper conveying path 6 (to be described later) by causing the paper feed roller 45 to rotate.

The paper ejection unit 5 includes a paper discharge tray 5*a* that is formed as a slope below the paper ejection space 12 between the above-described toner bottles 31Y, 31C, 31M, and 31K and the image reading unit 2 in the apparatus main body 10, and a discharge roller pair 5*b* that ejects (discharges) the paper that has passed through the fixing unit 33 to the discharge tray 5*a* through the paper conveying path 6 (to be described later). In this manner, the color copier 1 of the present embodiment includes a paper ejection unit of an intra-body paper ejection type that has a function to stack the paper ejected by the discharge roller pair 5*b* onto the discharge tray 5*a*.

The paper conveying path 6 includes a normal conveying path 6*a* of a vertical conveying system (vertical path system) that performs conveyance from bottom to top, i.e., from the paper feed unit 4 that is arranged in a lower part of the apparatus main body 10 to the paper ejection unit 5 that is arranged in an upper part of the apparatus main body 10, and a reverse conveying path 6*b* that reverses paper for duplex printing. The conveying paths as described above can be switched from one to the other by a switching claw 6*c* such that paper that has been guided to the reverse conveying path 6*b* by the switching claw 6*c* and conveyed to an upper part 6*e* of the reverse conveying path 6*b* by a reverse conveying roller pair 6*d* is reversed in a switch-back manner along with reverse rotation of the reverse conveying roller pair 6*d*, and then conveyed to the normal conveying path 6*a* located anterior to a registration roller pair 6*f*.

In the normal conveying path 6*a* and the reverse conveying path 6*b*, a plurality of conveying roller pairs are arranged at certain intervals corresponding to minimum paper size, and paper is conveyed by causing the conveying roller pairs to rotate while the conveying roller pairs sandwich the paper. Further, the registration roller pair 6*f* is arranged on the normal conveying path 6*a* below the secondary transfer nip, and the registration roller pair 6*f* adjusts a timing to convey paper to the secondary transfer nip on the basis of a command issued from the control unit.

The paper feed cassettes 40 and 41 that are characteristic units of the present embodiment will be described below. The paper feed cassette 40 on an upper stage and the paper feed cassette 41 on a lower stage have the same configuration; therefore, the paper feed cassette 40 on the upper stage will be described below.

Figure 2:
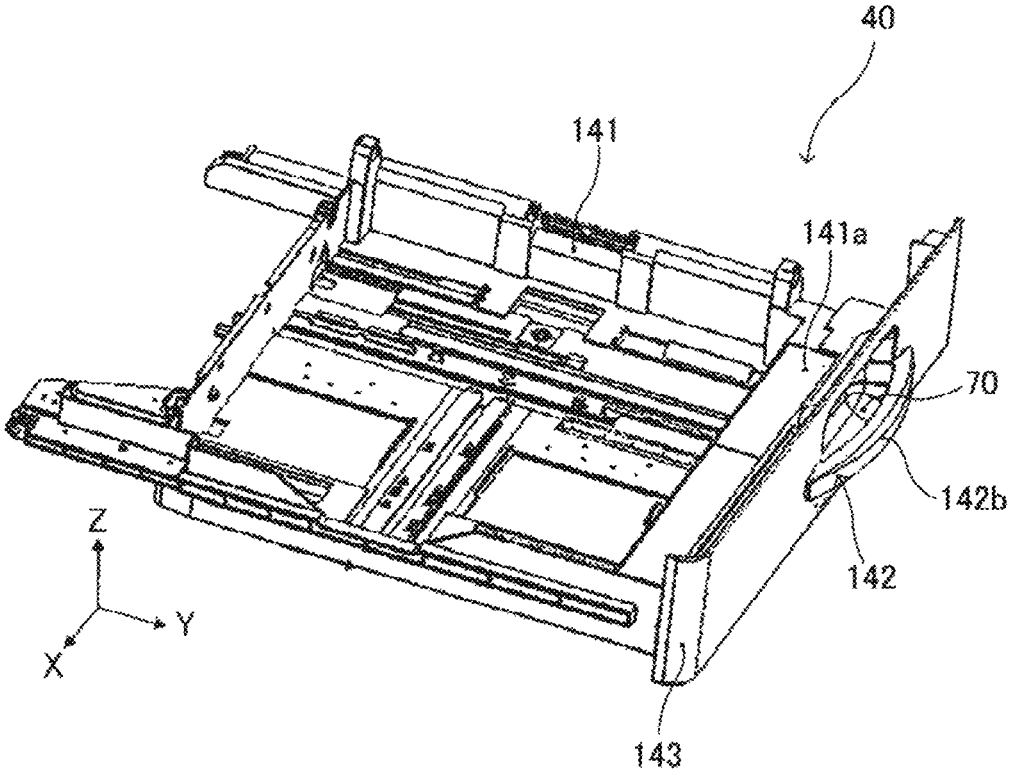
FIG. 2 is a perspective view of a paper feed cassette.
Figure 3:
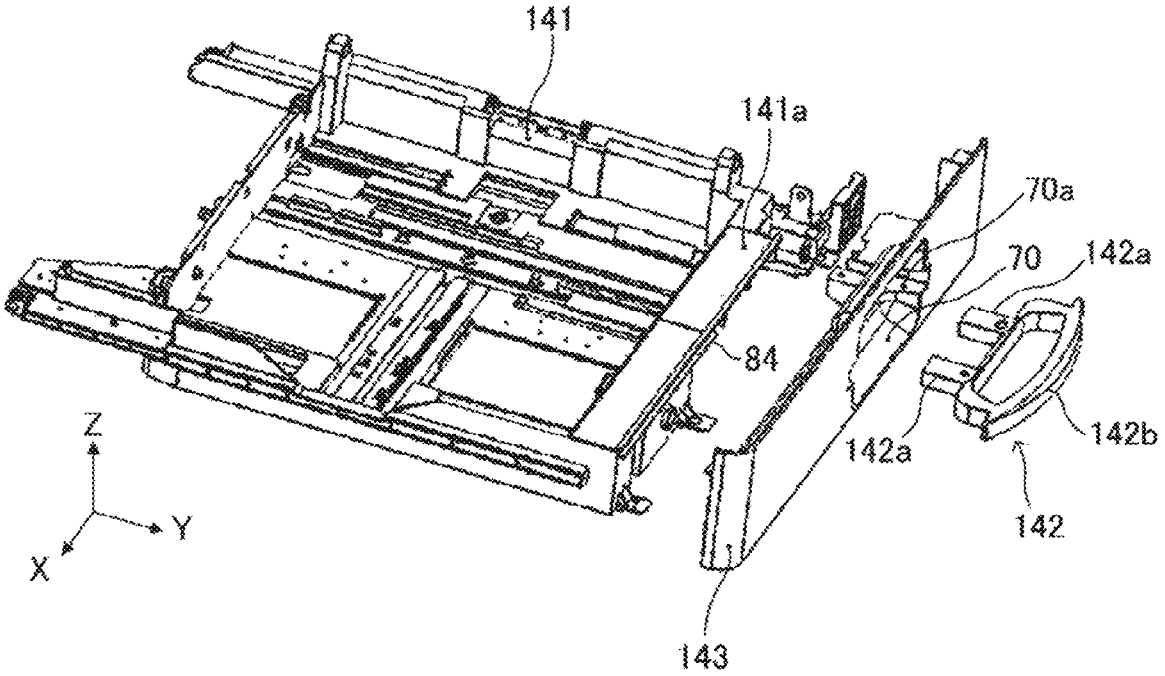
FIG. 3 is an exploded perspective view of the paper feed cassette.

FIG. 2 is a perspective view of the paper feed cassette 40, and FIG. 3 is an exploded perspective view of the paper feed cassette 40.

The paper feed cassette 40 mainly includes a paper feed tray 141 as a sheet housing portion, a handle 142, and a paper feed cover 143 as a cover member. The paper feed tray 141 is drawably disposed in the apparatus main body 10. Further, a top surface portion 141*a* is arranged on an end portion of the paper feed tray 141 in a drawing direction (the positive Y direction in the figure). The top surface portion 141*a* is a portion that catches eyes of a user when the paper feed cassette 40 is drawn. Therefore, in view of good appearance, the top surface portion 141*a* is formed in a planer shape without irregularities. Furthermore, the top surface portion 141*a* is a portion that catches eyes of the user when the paper feed cassette 40 is drawn, and therefore, in some cases, a seal in which the way to set paper in the top surface portion 141*a* is written may be attached to this portion. By forming the top surface portion 141*a* in a planer shape without irregularities, it is possible to attach the seal in a preferable manner. Moreover, a contacted portion 84 with which a contact rib 74 (see FIGS. 6A and 6B) of the paper feed cover 143 (to be described later) comes into contact is arranged in an end portion of the top surface portion 141*a* in the drawing direction.

The paper feed cover 143 is mounted to an end portion of the paper feed tray 141 in the drawing direction and has, in an approximately central part thereof, a recess 70 toward the paper feed tray 141. An opening 70*a*, through which mounting portions 142*a* of the handle 142 pass, is arranged in the recess 70.

The handle 142 includes a gripper 142*b* that is gripped by a user, and the mounting portions 142*a* to be mounted to the paper feed tray 141. The mounting portions 142*a* are arranged at two positions at a predetermined interval in a paper feed direction (the X direction in the figure). The handle 142 is mounted to the paper feed tray 141 by inserting the mounting portions 142*a* through the opening 70*a* that is arranged in the recess 70 of the paper feed cover 143 and fixing the mounting portions 142*a* to the paper feed tray 141 with screws.

As illustrated in FIG. 2, the handle 142 is mounted to the paper feed tray 141 such that the gripper 142*b* of the handle 142 crosses the recess 70 of the paper feed cover 143 in the paper feed direction (the X direction).

The paper feed tray 141, the handle 142, and the paper feed cover 143 are resin molded products. In the present embodiment, the handle 142 and the paper feed cover 143 are separated. With this configuration, as compared to a case in which the paper feed cover 143 and the handle 142 are integrally molded, it is possible to simplify a mold structure. Further, by separating the handle 142 and the paper feed cover 143, it is possible to improve the degree of freedom of design.

Figure 4A:
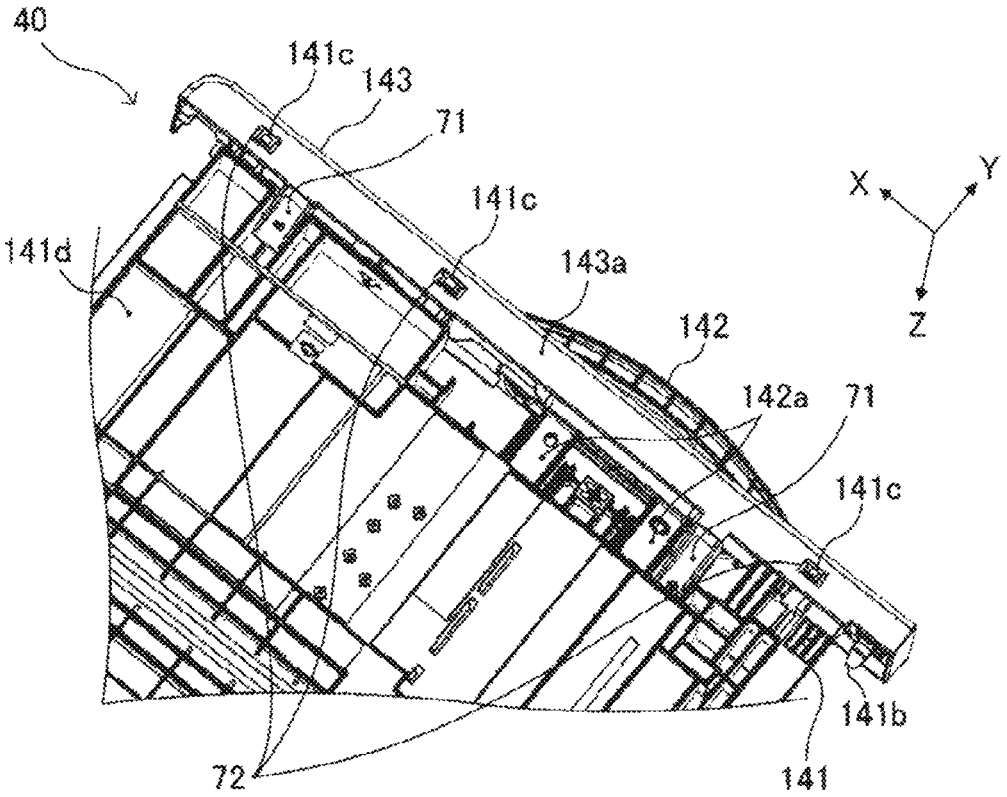
FIGS. 4A and 4B are diagrams for explaining how to mount a paper feed cover to a paper feed tray.
Figure 4B:
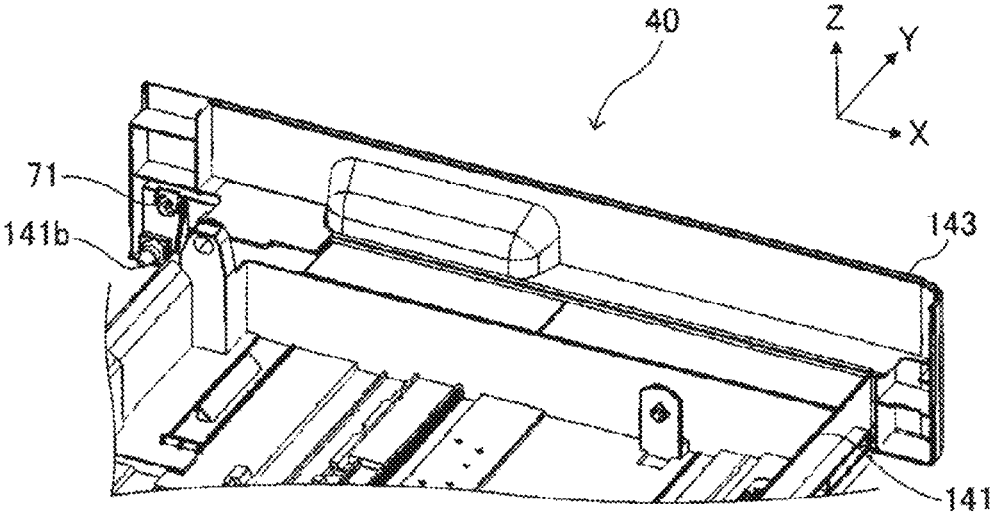

FIGS. 4A and 4B are diagrams for explaining how to mount the paper feed cover 143 to the paper feed tray 141, in particular, FIG. 4A is a perspective view of a vicinity of a lower end portion of the paper feed cassette 40 in the drawing direction, and FIG. 4B is a perspective view of a vicinity of an end portion of the paper feed cassette 40 in the drawing direction when viewed from a direction (the negative Y direction) opposite to the drawing direction.

As illustrated in FIG. 4A, three rectangular holding holes 72 are arranged at predetermined intervals in the paper feed direction (the X direction) on a lower surface portion 143*a* of the paper feed cover 143. Holding protrusions 141*c* of the paper feed tray 141 are fitted in the holding holes 72, so that the paper feed cover 143 is held by the paper feed tray 141.

As illustrated in FIG. 4A, the mounting portions 142*a* of the handle 142 are fastened in an approximately center in the paper feed direction on a bottom portion 141*d* of the paper feed tray 141. Further, the paper feed cover 143 includes fastening portions 71 on one side and the other side in the paper feed direction on a lower end thereof. Furthermore, as illustrated in FIG. 4B, the paper feed cover 143 further includes the fastening portion 71 in a vicinity of a positioning pin 141*b* that is arranged on one end portion of the paper feed tray 141 in the paper feed direction (one end portion in the negative X direction). Each of the fastening portions 71 includes a screw through hole through which a screw penetrates. By inserting a screw in the screw through hole of each of the fastening portions 71 and fastening the screws, the paper feed cover 143 is mounted to the bottom portion 141*d* of the paper feed tray 141.

Figure 5:
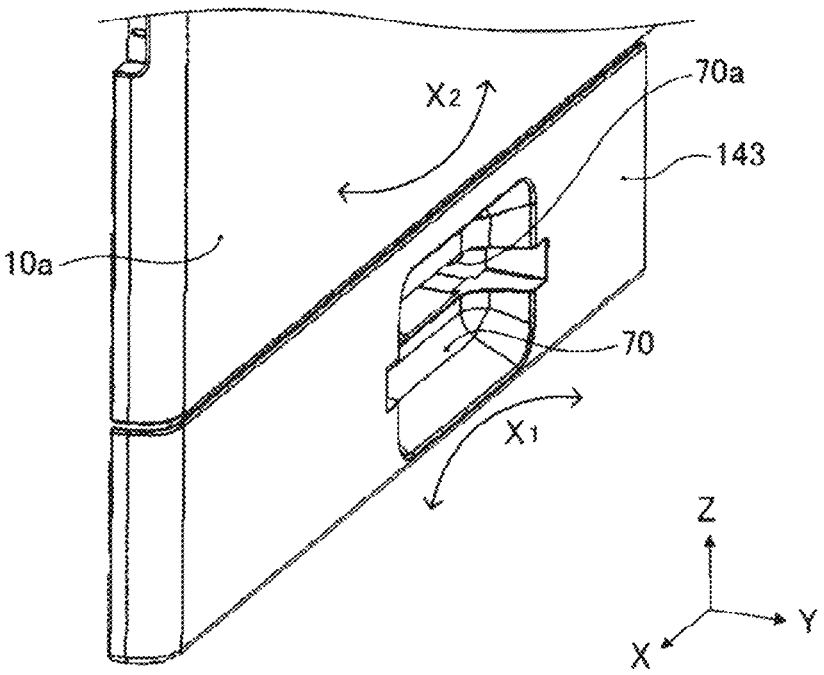
FIG. 5 is a perspective view of the paper feed cover and a main body cover.

FIG. 5 is a perspective view of the paper feed cover 143 and a main body cover 10*a*.

Meanwhile, in FIG. 5, the handle 142 is removed.

The paper feed cover 143 has the recess 70 toward the paper feed tray 141, and the opening 70*a* is formed on the recess 70. With provision of the opening 70*a* and the recess 70, warpage toward the paper feed tray 141 inevitably occurs in the recess 70 and a vicinity of the recess 70 as compared to other portions on the paper feed cover 143 that is a resin molded product, due to shrink at the time of molding.

Because the handle 142 is to be mounted to the paper feed tray 141, it is difficult to fix, to the bottom portion 141*d* of the paper feed tray 141, a vicinity of the center of the paper feed cover 143 in the X direction where the recess 70 is formed. Further, it is difficult to arrange a fixing portion of the paper feed cover 143 on the top surface portion 141*a* of the paper feed tray 141 for an appearance (appearance quality) reason. Therefore, parts of the paper feed cover 143 close to both ends in the X direction are fixed (fastened) to the bottom portion 141*d* of the paper feed tray 141, instead of fixing (fastening) the vicinity of the center of the paper feed cover 143 in the X direction to the paper feed tray 141.

In this manner, the vicinity of the center, i.e., the vicinity of the recess 70 of the paper feed cover 143 is not fixed to the paper feed tray 141, and the paper feed cover 143 is fixed to the paper feed tray 141 in such a manner that warpage as indicated by an arrow X1 in the figure occurs. As a result, a level difference occurs between the main body cover 10*a* and the paper feed cover 143, so that appearance quality of the apparatus may be degraded. In particular, in the present embodiment, as indicated by an arrow X2 in the figure, warpage occurs in the main body cover 10*a* in an opposite direction of the warpage direction of the paper feed cover 143, so that the level difference between the main body cover 10*a* and the paper feed cover 143 increases and appearance quality of the apparatus is degraded.

To cope with this, in the present embodiment, a contact portion that comes into contact with the paper feed tray 141 is arranged in a portion corresponding to the recess 70 on a facing surface of the paper feed cover 143, where the facing surface faces the paper feed tray 141, and the contact portion is brought into contact with the paper feed tray 141 to reduce warpage of the paper feed cover 143. This will be described in detail below with reference to the drawings.

Figure 6A:
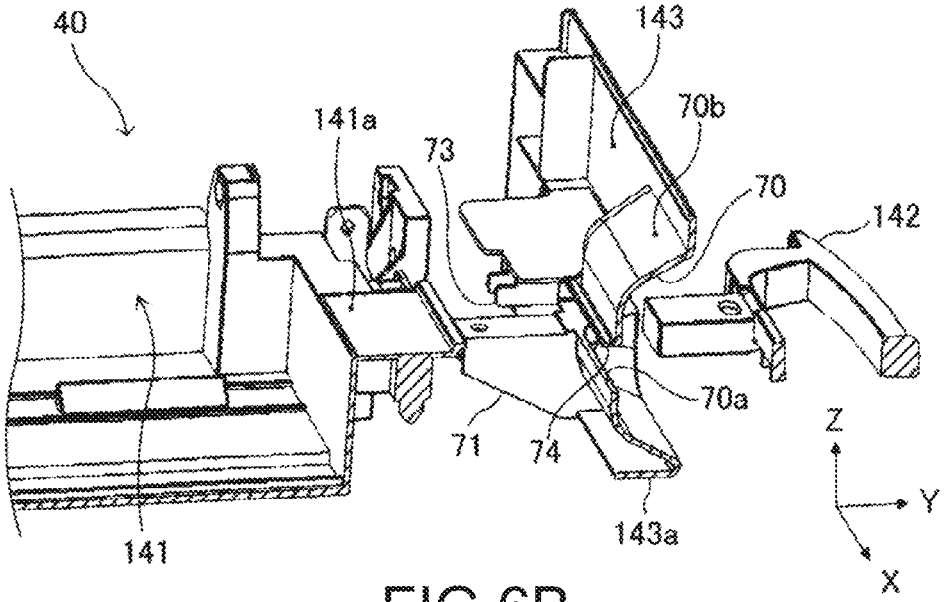
FIG. 6A is an exploded perspective cross-sectional view of the paper feed cassette.
Figure 6B:
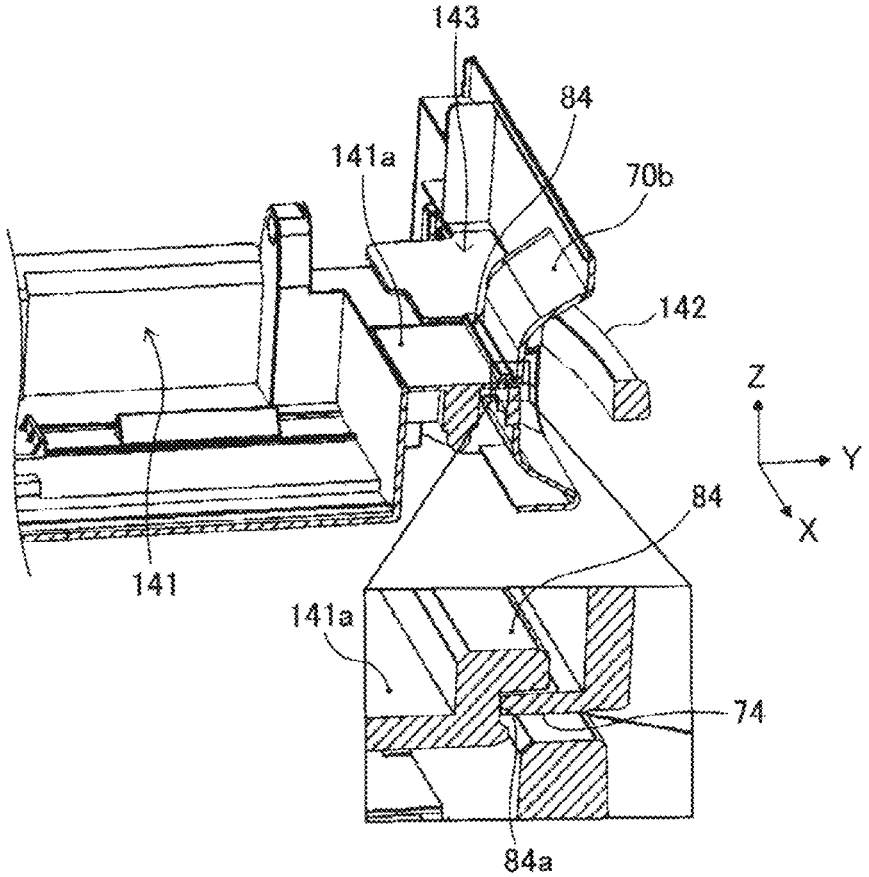
FIG. 6B is a perspective cross-sectional view of the paper feed cassette.

FIG. 6A is an exploded perspective cross-sectional view of the paper feed cassette 40, and FIG. 6B is a perspective cross-sectional view of the paper feed cassette 40.

As illustrated in FIGS. 6A and 6B, on a back surface 70*b* of the recess 70, which is a portion corresponding to the recess 70 on the facing surface of the paper feed cover 143 facing the paper feed tray 141, the contact rib 74 that protrudes from the back surface 70*b* is arranged. Further, the paper feed cover 143 includes a facing rib 73 as a facing portion that faces the top surface portion 141*a* of the paper feed tray 141 from below.

The contacted portion 84 is arranged on an end portion of the top surface portion 141*a* of the paper feed tray 141 in the drawing direction (the positive Y direction). The contacted portion 84 includes a contact recess 84*a* in which the contact rib 74 is fitted as illustrated in FIG. 6B.

Figure 7:
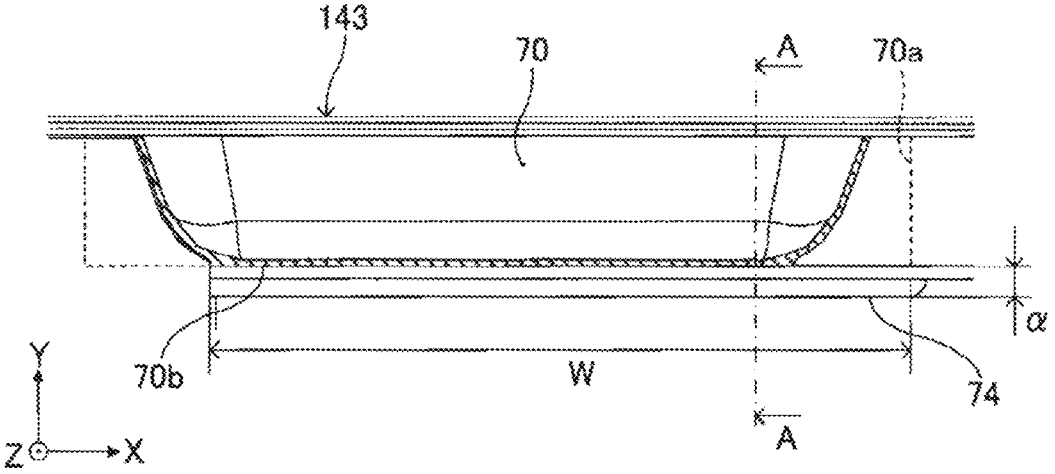
FIG. 7 is a horizontal cross-sectional view of a vicinity of a recess of the paper feed cover.
Figure 8:
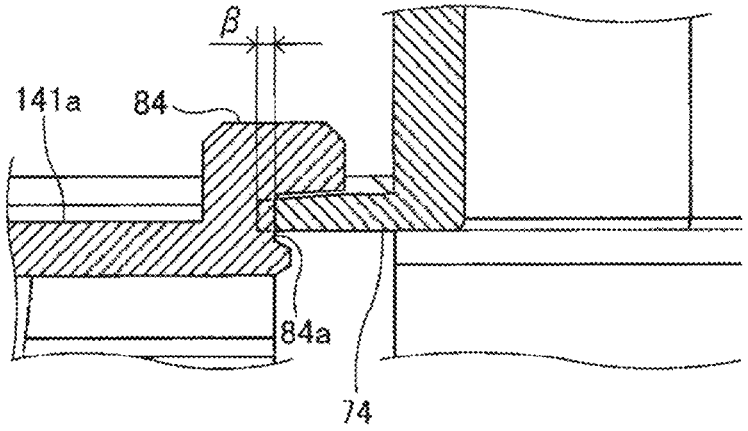
FIG. 8 is a cross sectional view cut along A-A in FIG. 7.

FIG. 7 is a horizontal cross-sectional view of the vicinity of the recess 70 of the paper feed cover 143, and FIG. 8 is a cross-sectional view cut along A-A in FIG. 7.

As illustrated in FIG. 7, the contact rib 74 has a certain length (denoted by W in the figure) in the X direction, and an end portion of the contact rib 74 in the positive X direction is located at approximately the same position as the position of an end portion of the opening 70*a* in the positive X direction as indicated by a dashed line in the figure. Further, the contact rib 74 protrudes from the back surface 70*b* by $\alpha$ millimeters (mm). It is sufficient to appropriately determine a protrusion amount of the contact rib 74 in consideration of an amount of improvement in warpage of the paper feed cover 143, part-to-part variability, assembly performance, and strength of the contact rib 74. In the present embodiment, the protrusion amount of the contact rib 74 is set to be equal to or larger than 1.0 mm and equal to or smaller than 1.5 mm. Further, as illustrated in FIG. 8, an intrusion amount $\beta$ of the contact rib 74 (a pressed amount of the paper feed cover 143 by the paper feed tray 141) with respect to a bottom surface of the contact recess 84*a* of the contacted portion 84 is set to be equal to or larger than 0.5 mm and equal to or smaller than 1.0 mm.

If the protrusion amount of the contact rib 74 exceeds 1.5 mm, the contact rib 74 is easily deformed, so that when the contact rib 74 comes into contact with the bottom surface of the contact recess 84*a*, the contact rib 74 may be deformed and it may become difficult to achieve a desired warpage improvement effect. Further, the contact rib 74 may be broken when the contact rib 74 comes into contact with the bottom surface of the contact recess 84*a*. Furthermore, if the protrusion amount exceeds 1.5 mm, the intrusion amount $\beta$ with respect to the bottom surface of the contact recess 84*a* increases, so that it may become difficult to assemble the paper feed cover 143. Therefore, it is preferable to set the protrusion amount of the contact rib 74 to 1.5 mm or smaller.

If the protrusion amount is smaller than 0.5 mm, it may be difficult to achieve an effect to improve warpage of the paper feed cover 143 by the contact rib 74 due to part-to-part variability. Therefore, it is preferable to set the protrusion amount to 0.5 mm or larger.

In the present embodiment, if the fastening portion 71 arranged on the end portion of the paper feed tray 141 in the paper feed direction (negative X direction) as illustrated in FIG. 4B is fastened with a screw, a distal end portion of the contact rib 74 is fitted into the contact recess 84*a*. Then, a distal end of the contact rib 74 comes into contact with the bottom surface of the contact recess 84*a* (a surface facing the distal end of the contact rib 74). In this state, if the screw is further tightened, the bottom surface of the contact recess 84*a* presses the contact rib 74 in the drawing direction, so that the recess 70 and the vicinity of the recess 70 on the paper feed cover 143 are deformed in the drawing direction. Then, if the paper feed cover 143 is fastened to the paper feed tray 141, the contact rib 74 is pressed by the bottom surface of the contact recess 84*a* by the intrusion amount $\beta$ as illustrated in FIG. 8, so that the recess 70 on the paper feed cover 143 is deformed by the intrusion amount $\beta$ in the drawing direction. With this configuration, warpage of the paper feed cover 143 is improved, so that the level difference between the paper feed cover 143 and the main body cover 10*a* is reduced. As a result, degradation of appearance quality is improved.

Meanwhile, the contact portion of the paper feed cover 143 may be formed in a concave shape, and the contacted portion 84 of the paper feed tray 141 may be formed in a rib shape.

Furthermore, in the present embodiment, as described above, a fixing unit for fixing the paper feed cover 143 is not arranged on the top surface portion 141*a* of the paper feed tray 141 for an appearance reason, and an upper side of the paper feed cover 143 is not fixed to the paper feed tray 141. Therefore, backlash in the drawing direction occurs in an upper portion of the paper feed cover 143 with respect to the paper feed tray 141.

The paper feed cassette 40 is detachable from the apparatus main body. The paper feed cassette 40 is detachable from the apparatus main body in the following manner. That is, the paper feed cassette 40 is first drawn from the apparatus main body, and thereafter the paper feed cassette 40 is lifted up in an obliquely upward direction, so that the paper feed cassette 40 is detached from the apparatus main body 10. When the paper feed cassette 40 is detached from the apparatus main body, lifting up the paper feed cassette 40 in the obliquely upward direction can be made easy by grasping the paper feed cover 143, rather than holding the handle 142. Further, this makes it possible to stably lift up the paper feed cassette 40. Therefore, in general, a user detaches the paper feed cassette 40 from the apparatus main body 10 by holding the paper feed cover 143.

When the paper feed cassette 40 is detached from the apparatus main body by being lifted up in the obliquely upward direction, moment acts on the paper feed tray 141 about the holding protrusions 141*c* (see FIG. 4A) of the paper feed cover 143 due to the weight of the paper feed tray 141. Therefore, when the paper feed cassette 40 is detached from the apparatus main body 10, the paper feed cassette 40 is inclined such that a part (an end portion in the negative Y direction) of the paper feed tray 141 opposite to the paper feed cover 143 is located lower than a part close to the paper feed cover. In this manner, the paper feed tray 141 moves relative to the paper feed cover 143, so that operability in detachment of the paper feed cassette 40 from the apparatus main body may be reduced. Further, the fastening portions 71 of the paper feed cover 143 are deformed with inclination of the paper feed tray 141. As a result, a large stress is applied to a predetermined portion of the paper feed cover 143, and the paper feed cover 143 may be broken.

In particular, if the paper feed cassette 40 is to be detached from the apparatus main body 10 in a state in which sheets are stacked to a maximum extent on the paper feed tray 141, the paper feed tray 141 is largely inclined and the operability in detachment of the paper feed cassette 40 from the apparatus main body is further reduced. Furthermore, the possibility that the paper feed cover 143 may be broken increases. Moreover, after the paper feed cassette 40 is detached from the apparatus main body 10, when inclination of the paper feed tray 141 is to be eliminated by placing the paper feed cassette 40 on a table or the like, an end portion of the paper feed cover 143 close to the paper feed tray may accidentally be placed on the top surface portion 141*a* of the paper feed tray 141.

Therefore, in the present embodiment, the facing rib 73 is arranged to prevent inclination of the paper feed tray 141 as described above.

Figure 9:
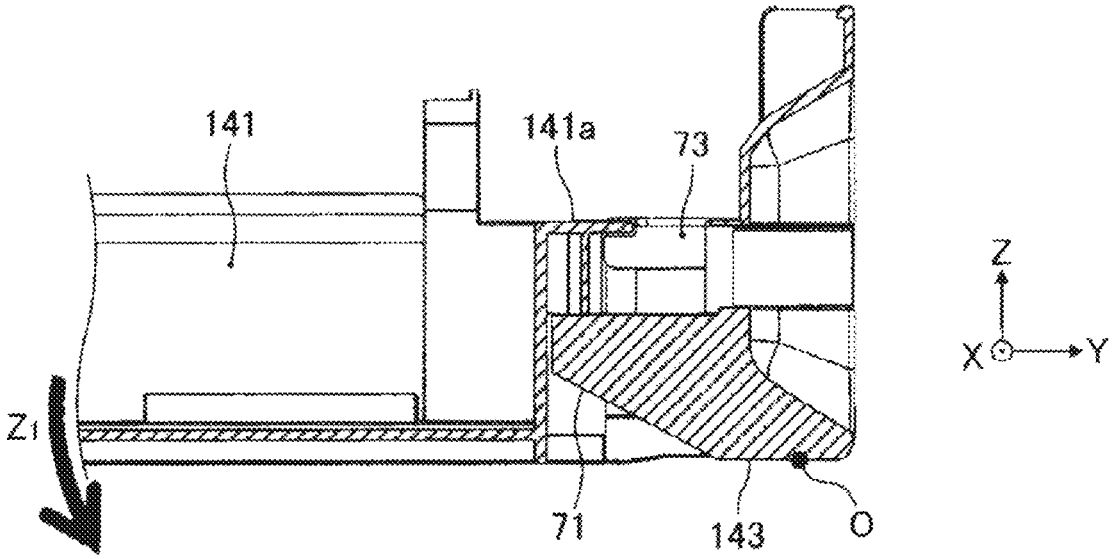
FIG. 9 is a cross-sectional view of the paper feed cassette in the vicinity of a facing rib.

FIG. 9 is a cross-sectional view of the paper feed cassette 40 in the vicinity of the facing rib 73.

As illustrated in FIG. 9, a part of the facing rib 73 close to distal end faces the top surface portion 141*a* of the paper feed tray 141 from below. With this configuration, when the user holds the paper feed cover 143 and lifts up the paper feed cassette 40 in the obliquely upward direction to detach the paper feed cassette 40 from the apparatus main body, and if the paper feed tray 141 is to be inclined in a direction of an arrow Z1 in the figure about a point O (the positions of the holding protrusions 141*c*) in the figure, a lower surface of the top surface portion 141*a* of the paper feed tray 141 comes into contact with the facing rib 73. Accordingly, the facing rib 73 prevents the paper feed tray 141 from being inclined, so that inclination of the paper feed tray 141 at the time of detachment of the paper feed cassette 40 from the apparatus main body 10 is restricted. Therefore, the operability in detachment of the paper feed cassette 40 from the apparatus main body 10 can be improved. Furthermore, a stress applied to the predetermined portion of the paper feed cover 143 at this time is reduced, so that it is possible to prevent the paper feed cover 143 from being broken.

Moreover, in the present embodiment, as illustrated in FIG. 8, the contact rib 74 is configured to be fitted in the contact recess 84*a*. Therefore, the contact rib 74 also prevents the paper feed tray 141 from being inclined. With this configuration, it is possible to further prevent the paper feed tray 141 from being inclined when a user detaches the paper feed cassette 40 from the apparatus main body 10. Furthermore, restriction by both of the facing rib 73 and the contact rib 74 makes it possible to distribute a stress that is applied to the ribs at the time of the restriction, so that it is possible to further prevent the facing rib 73 from being broken as compared to a case in which the inclination of the paper feed tray 141 is restricted by only the facing rib 73.

The above cases are mere examples, and specific effects are achieved for each of the following aspects.

Aspect 1

A sheet storage apparatus, such as the paper feed cassette 40, includes a sheet housing portion, such as the paper feed tray 141, that is drawably disposed in the apparatus main body 10 and houses a sheet, such as paper, the handle 142 for drawing the sheet housing portion, and a cover member, such as the paper feed cover 143, that is mounted to an end portion of the sheet housing portion in a drawing direction and has, in a portion facing the handle 142, the recess 70 toward the sheet housing portion. A contact portion, such as the contact rib 74, that comes into contact with the sheet housing portion is diposed at a position (in the embodiment, on the back surface 70*b* of the recess 70) corresponding to a portion in which the recess 70 is formed, on an facing surface of the cover member, where the facing surface faces the sheet housing portion.

In general, the cover member, such as the paper feed cover 143, is a resin molded product, and, if the cover member has the recess 70 toward the sheet housing portion, warpage toward the sheet housing portion inevitably occurs in the recess 70 and the vicinity of the recess 70 as compared to other portions on the cover member due to shrink at the time of molding; therefore, variability with respect to a predetermined shape may occur and appearance quality may be degraded. In contrast, in Aspect 1, the contact portion, such as the contact rib 74, of the cover member comes into contact with the sheet housing portion, such as the paper feed tray 141, so that the recess 70 and the vicinity of the recess 70 on the cover member are pressed by the sheet housing portion. Accordingly, the recess 70 and the vicinity of the recess 70 on the cover member are displaced, so that warpage of the cover member is reduced. With this configuration, it is possible to reduce variability with respect to the predetermined shape of the cover member, so that it is possible to reduce degradation in appearance quality of the apparatus.

Aspect 2

In Aspect 1, the contact portion, such as the contact rib 74, is a rib that protrudes from the facing surface (in the present embodiment, the back surface 70*b* of the recess 70) by a length equal to or larger than 1 mm and equal to or smaller than 1.5 mm.

With this configuration, as described in the embodiment, it is possible to achieve improvement in warpage of the cover member, such as the paper feed cover 143, and prevent the contact portion, such as the contact rib 74, from being broken.

Aspect 3

In Aspect 1 or 2, the cover member, such as the paper feed cover 143, is not fixed to an upper portion, such as the top surface portion 141*a*, of the sheet housing portion, such as the paper feed tray 141, and the cover member includes a facing portion, such as the facing rib 73, that faces the upper portion of the sheet housing portion from below.

With this configuration, as described in the embodiment, the facing portion, such as the facing rib 73, comes into contact with the upper portion, such as the top surface portion 141*a*, of the sheet housing portion, such as the paper feed tray 141, and restricts inclination of the sheet housing portion. Therefore, it is possible to reduce degradation in operability when a user detaches the sheet storage apparatus, such as the paper feed cassette 40, from the apparatus main body 10 while holding the cover member, such as the paper feed cover 143. Furthermore, it is possible to reduce a stress that is applied to the cover member when the sheet storage apparatus is detached from the apparatus main body 10, so that it is possible to prevent the cover member from being broken.

Aspect 4

An image forming apparatus includes a sheet storage apparatus, such as the paper feed cassette 40, conveys a sheet stored in the sheet storage apparatus and form an image on the sheet, wherein the sheet storage apparatus is the sheet storage apparatus of any of Aspect 1 to 3.

With this configuration, it is possible to prevent a level difference from occurring between the main body cover 10*a* of the apparatus main body and the cover member, such as the paper feed cover 143, of the sheet storage apparatus, such as the paper feed cassette 40.

According to an embodiment, it is possible to reduce degradation in appearance quality of an apparatus.

The above-described embodiments are illustrative and do not limit the present invention. Thus, numerous additional modifications and variations are possible in light of the above teachings. For example, at least one element of different illustrative and exemplary embodiments herein may be combined with each other or substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

What is claimed is:

1. A sheet storage apparatus comprising:

a sheet housing portion drawably within an apparatus main body and configured to house a sheet, the sheet housing portion having a contacted portion extending therefrom in a drawing direction of the sheet housing portion;

a handle for drawing the sheet housing portion; and a cover member mounted to an end portion of the sheet housing portion in the drawing direction and having, in a portion facing the handle, a recess toward the sheet housing portion, the cover member including a facing surface facing the sheet housing portion, the cover member having a contact portion that includes a rib protruding from the facing surface of the cover member at position corresponding to the recess, the rib configured to come into contact and engage with a contact recess of the contacted portion of the sheet housing portion, wherein the rib protrudes from the facing surface by a length equal to or larger than 1 millimeter and equal to or smaller than 1.5 millimeters.

2. The sheet storage apparatus according to claim 1, wherein the cover member is not fixed to an upper portion of the sheet housing portion, and the cover member includes a facing portion configured to face the upper portion of the sheet housing portion from below.

3. An image forming apparatus comprising:

the sheet storage apparatus of claim 1; and the apparatus main body, wherein the image forming apparatus is configured to convey a sheet stored in the sheet storage apparatus and form an image on the sheet.

4. The sheet storage apparatus according to claim 1, wherein a distal end of the rib is configured to contact a bottom surface of the contact recess, when the contact portion engages with the contact recess.

5. The sheet storage apparatus according to claim 4, wherein the contact recess of the contacted portion is configured to press the distal end of the rib in the drawing direction.

6. The sheet storage apparatus according to claim 5, wherein the contact recess of the contacted portion is configured to press the distal end of the rib in the drawing direction to counteract warpage of the cover member.

7. A sheet storage apparatus, comprising:

a sheet housing portion drawably within an apparatus main body and configured to house a sheet, the sheet housing portion having a contacted portion extending therefrom in a drawing direction of the sheet housing portion;

a handle for drawing the sheet housing portion; and a cover member mounted to an end portion of the sheet housing portion in the drawing direction and having, in a portion facing the handle, a recess toward the sheet housing portion, the cover member including a facing surface facing the sheet housing portion, the cover member having a contact portion that includes a rib protruding from the facing surface of the cover member at position corresponding to the recess, the rib configured to come into contact and engage with a contact recess of the contacted portion of the sheet housing portion, wherein ends of the cover member are configured to fasten to a bottom portion of the sheet housing portion while a center of the cover member is not fastenable to the sheet housing portion.

8. A sheet storage apparatus, comprising:

a sheet housing portion drawably within an apparatus main body and configured to house a sheet, the sheet housing portion having a contacted portion extending therefrom in a drawing direction of the sheet housing portion;

a handle for drawing the sheet housing portion; and a cover member mounted to an end portion of the sheet housing portion in the drawing direction and having, in a portion facing the handle, a recess toward the sheet housing portion, the cover member including a facing surface facing the sheet housing portion, the cover member having a contact portion that includes a rib protruding from the facing surface of the cover member at position corresponding to the recess, the rib configured to come into contact and engage with a contact recess of the contacted portion of the sheet housing portion, wherein the rib protrudes from the facing surface by a length less than or equal to 1.5 millimeters.

* * * * *